United States Patent [19]

Nealey

[11] Patent Number: 4,750,894

[45] Date of Patent: Jun. 14, 1988

[54] LIFERAFT

[75] Inventor: Christopher H. Nealey, Wallasey, United Kingdom

[73] Assignee: Brt Plc, United Kingdom

[21] Appl. No.: 827,762

[22] Filed: Feb. 7, 1986

[30] Foreign Application Priority Data

Feb. 7, 1985 [GB] United Kingdom ..... 8503135

[51] Int. Cl.[4] ..... B63B 35/58

[52] U.S. Cl. ..... 441/40; 114/345

[58] Field of Search ..... 114/345, 348, 349; 441/38, 40, 41

[56] References Cited

U.S. PATENT DOCUMENTS

| | | | |
|---|---|---|---|
| 2,710,978 | 6/1955 | Alderfer | 441/41 |
| 2,764,766 | 10/1956 | Boyle et al. | 441/38 |
| 3,092,854 | 6/1963 | Manhart | 441/38 |
| 3,359,579 | 12/1967 | Reffell et al. | 114/345 |

FOREIGN PATENT DOCUMENTS

| | | | |
|---|---|---|---|
| 1116101 | 10/1961 | Fed. Rep. of Germany . | |
| 1160754 | 1/1964 | Fed. Rep. of Germany . | |
| 625129 | 6/1949 | United Kingdom . | |
| 727187 | 3/1955 | United Kingdom . | |
| 823922 | 11/1959 | United Kingdom . | |
| 887940 | 1/1962 | United Kingdom | 441/41 |

*Primary Examiner*—Joseph F. Peters, Jr.
*Assistant Examiner*—Jesûs D. Sotelo
*Attorney, Agent, or Firm*—Harry M. Weiss

[57] ABSTRACT

A liferaft having a seat chamber which serves as a cushion between occupants of the raft and a deck in a "dry evacuation" situation, to avoid occupants, in a partially filled raft, from totally compressing the seat chamber and suffering injury due to impacting the deck. The seat chamber is internally divided by dividers into a plurality of sub-compartments each divider being in the form of a wall which allows gas to pass for inflation but resists rapid expulsion of gas from any one subcompartment upon impact.

11 Claims, 1 Drawing Sheet

LIFERAFT

This invention relates to a liferaft.

For the emergency evacuation of personnel from oil production platforms and other sea-girt structures, it is usual to provide a plurality of inflatable liferafts which can be stored easily and compactly and well protected and deployed rapidly in an emergency. The liferafts can be inflated on the structure, loaded and then lowered as by a crane or davit if time permits, or may in more serious emergencies be thrown into the sea, inflated and occupied from the water.

A known such liferaft includes an annular internal inflatable chamber which serves as a seat. This chamber also has the additional function, when the raft is loaded at deck level and lowered to the water, of serving to protect the occupants from injury due to the impact of the raft with the water.

It has recently been proposed that in circumstances where immediate evacuation is not imperative, the safest way of evacuating a sea structure is to inflate the raft, load it, and lower it fully laden onto the deck of a rescue craft, such as a support ship.

In this circumstance there is a much greater chance of injury to persons in the raft due to impact with the dec, because, naturally, the raft is lowered as quickly as possible, and if it hits the deck when the deck is itself moving upwards under wave action considerable force can be transmitted to the occupants' spines.

For this reason a raft having an inflatable seat is desirable as the seat acts as a cushion between the occupants and the deck. However, most liferafts have a single elongate, eg annular, inflatable chamber providing the major seat support. When such a raft is fully occupied, as by twenty persons, they can be adequately protected against impact injury. However, if a raft is half loaded or less than half-loaded, the occupants' momentum, on impact, carries them downwards, and the force exerted on the chamber is not resisted, but merely acts to inflate the unoccupied part(s) of the chamber, and the occupants can completely compress the chamber and contact the deck with force sufficient to cause injury or death. It is an object of the present invention, therefore, to provide an improved liferaft which does not suffer from this disadvantage.

The invention provides a liferaft having an inflatable seat chamber which acts as a cushion between occupants and a surface in a dry evacuation, the seat chamber being internally divided, by a plurality of dividers each allowing limited gas flow therethrough, into a plurality of sub-compartments, the dividers allowing all the subcompartments to be inflated from a common source but preventing complete flattening of any one sub-compartment by the momentum of the occupants upon impact of the raft with a surface.

The dividers may be constituted by a plurality of walls of flexible sheet material each having an aperture or apertures.

Alternatively the divisions can be of limitedly gas permeable material.

Preferably the dividers are each of generally domed configuration having a generally frusto-conical portion peripherally secured to the wall of the compartment and a circular or part spherical central portion provided with said aperture(s). The periphery of the outer portion can be adhered to the wall of the seat ring and can be reinforced with a hinge tape to allow operation in both directions.

The aperture(s) in the central portion can be reinforced with an annular patch to resist tearing under pressure.

The invention will be described further, by way of example, with reference to a preferred embodiment thereof, it being understood that the following description is illustrative and not limitative of the scope of the invention. In the drawings.

Figure 1:
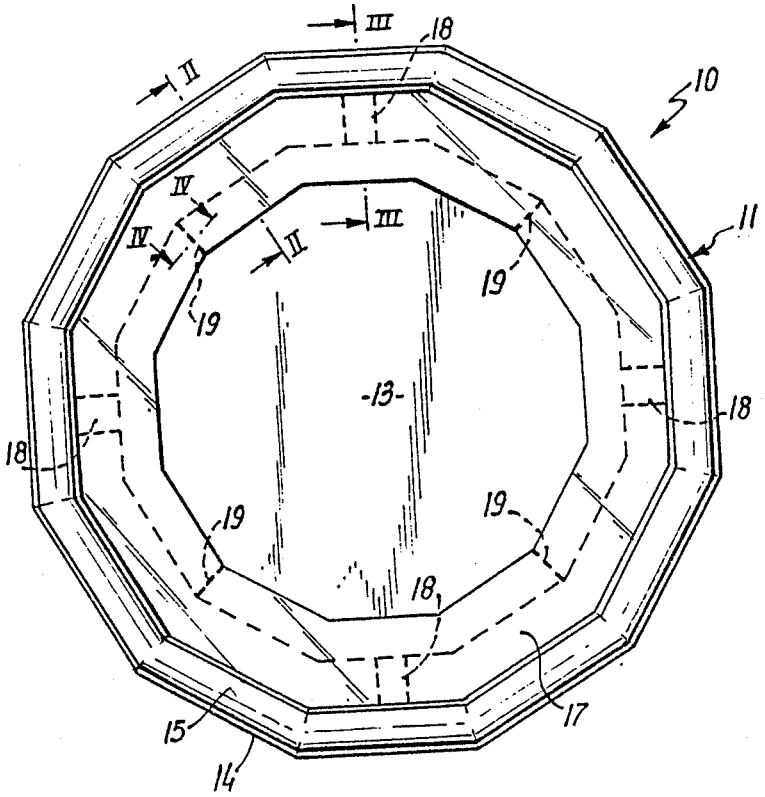
FIG. 1 is a plan view of a preferred liferaft of the invention, with a canopy omitted for clarity.
Figure 2:
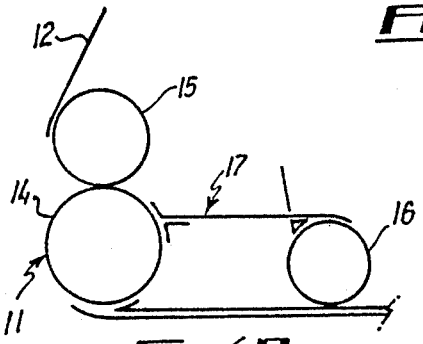
FIG. 2 is an enlarged cross-section on line II—II of FIG. 1.
Figure 3:
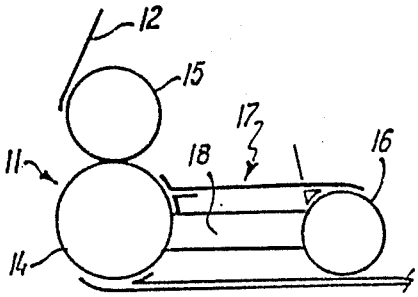
FIG. 3 is an enlarged cross-section on line III—III of a FIG. 1.
Figure 4:
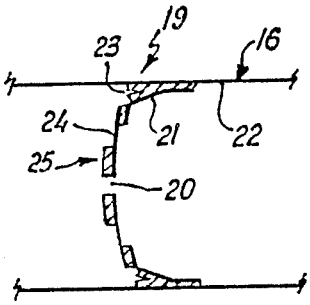
FIG. 4 is an enlarged cross-section on line IV—IV of FIG. 1.

A preferred liferaft 10 of the invention is twelve sided in plan, is an inflatable structure made wholly from flexible air-impermeable material and adapted to be stored in a compact, folded package and inflated, when needed, by a cylinder of compressed gas (not shown). In FIG. 1 a canopy forming an enclosure for occupants of the raft has been omitted. A sheet forming a canopy 12 is illustrated fragmentally in FIGS. 2 and 3, and it will be appreciated than an apex of the canopy 12 an attachment part of points will be provided for attachment of the raft to a davit or like crane on a vessel or sea-girt structure.

The raft 10 has a base 11 consisting of a floor panel 13, a main annular buoyancy chamber 14, a second superposed annular backrest chamber 15, an annular spaced inwards seat chamber 16 and a seat-panel 17 extending from chamber 14 to chamber 16. A plurality of tubular ducts 18 interconnect chamber 14 and chamber 16 and are provided with pressure and flow control valves (not shown) to control inflation of chamber 16 from chamber 14. The various chambers and the panel 17 are interconnected by adhesive.

In a so-called 'dry' evacuation wherein a loaded raft 10 is transferred by a davit or like crane onto the deck of a support or rescue vessel the raft 10 hits the deck of such vessel quite hard. When the raft 10 is fully loaded the seat chamber 16, some 280 mm in diameter, provides adequate cushioning for raft occupants sitting on the seat and prevents spinal damage. However, if a partially loaded raft is lowered, as may often happen when a final one of a plurality of rafts is lowered, the momemtum of the occupants may be sufficient to compress the seat chamber 16 beneath them so that they hit the vessel deck with considerable force. The speed of descent is such that a direct deck impact of this sort can cause severe injury. To obviate or reduce this danger the seat chamber 16 is internally divided into four sub-compartments by means of dividers 19 which each have an aperture 20 which is large enough to allow rapid and adequate initial inflation of al the sub-compartments, but, in the above described deck impact, provides sufficient resistance to air flow out of any one sub-compartment to prevent its evacuation by the momentum of raft occupants upon impact.

Each divider 19 comprises a frusto-conical outer portion 21 adhered to the walling 22 of chamber 16 with the addition of a reinforcing annular hinge strap 23 also of flexible material. Portion 21 is attached to a central circular or part-spherical central portion 24 having aperture 20 therein. Aperture 20 is surrounded by reinforcement 25 to reduce the likelihood of tearing under the impact pressure on deck engagement. The construction of the divider 19 allows it to operate with impact pressure from either side without damage, the generally domed configuration making it very resistant to tearing under impact. The raft of the invention is particularly effective in preventing injury when a partially-loaded raft is used in a dry evacuation.

Variations can be made to the above. For example the number of dividers can be varied from, say, three to six depending on the degree of protection required. Each divider can have one or more apertures whose (total) area is consistent with the above criteria. For a chamber 16 some 280 mm in diameter a single aperture 20 some 20 to 30 mm in diameter, preferably 25 mm has been found satisfactory. It is believed that the area of each aperture (or group of apertures) should amount to between 0.5% and 1.2% of the cross-sectional area of the seat chamber.

I claim:

1. A liferaft for use in a dry crane or davit launched evacuation rescue, comprising in combination:

a base having a floor panel;

a generally circular main annular buoyancy chamber affixed to and superimposed upon said base;

an annular backrest chamber superimposed upon and attached to said main annular buoyancy chamber;

an annular spaced seat chamber affixed to said base and disposed generally concentrically within said generally circular main annular buoyancy chamber and superimposed upon said floor panel of said base;

a seat panel mamber attached to and extending from an upper surface of said main annular buoyancy chamber to an upper surface of said annular spaced seat chamber and subtending an annular space therebetween;

a plurality of dividing walls internaly dividing said seat chamber into a plurality of sub-compartments while allowing a limited bi-directional gas flow therethrough and preventing complete flattening of any one sub-compartment by the momentum of the occupants upon impact of the raft with a surface;

a plurality of ducts interconnecting said main buoyancy chamber with said annular spaced seat chamber; and non-return valve means disposed within said ducts for controlling inflation of said buoyancy chamber and said annular spaced seat chamber and preventing exhaustion from said annular spaced seat chamber impact.

2. A liferaft according to claim 1, wherein each of said dividing means comprises a wall of flexible sheet material having limited gas permeability.

3. A liferaft according to claim 1, wherein each of said plurality of dividing walls further comprises at least one of a plurality of bi-directional gas apertures passing therethrough.

4. A liferaft according to claim 3, wherein each of said dividing means has a generally dome-shaped configuration.

5. A liferaft according to claim 4, wherein each of said walls has an outer frusto-conical portion and a central circular portion.

6. A liferaft according to claim 5, wherein each of said plurality of apertures is surrounded by a reinforcing annulus.

7. A liferaft according to claim 6, wherein each of said plurality of apertures has an area within the range of about 0.5% to 1.2% of the cross-sectional area of the seat chamber.

8. A liferaft according to claim 4, wherein each of said plurality of apertures is surrounded by a reinforcing annulus.

9. A liferaft according to claim 8, wherein each of said plurality of apertures has an area within the range of about 0.5% to 1.2% of the cross-sectional area of the seat chamber.

10. A liferaft according to claim 3, wherein each of said plurality of apertures is surrounded by a reinforcing annulus.

11. A liferaft according to claim 10, wherein each of said plurality of apertures has an area within the range of about 0.5% to 1.2% of the cross-sectional area of the seat chamber.

* * * * *